United States Patent [19]

Sauer et al.

[11] 4,253,505

[45] Mar. 3, 1981

[54] VALVE CONTROL CONSTRUCTION FOR A FILLING MACHINE

[75] Inventors: Henry Sauer, Menomonee Falls; Steven A. Lockhart, Mequon, both of Wis.

[73] Assignee: Jos. Schlitz Brewing Company, Milwaukee, Wis.

[21] Appl. No.: 152,182

[22] Filed: May 22, 1980

Related U.S. Application Data

[63] Continuation of Ser. No. 937,149, Aug. 28, 1978, abandoned.

[51] Int. Cl.[3] ..... B67C 3/28

[52] U.S. Cl. ..... 141/147; 141/268; 251/208; 251/251

[58] Field of Search ..... 251/251, 205–209; 137/625.3, 625.31, 625.46; 141/1–12, 37–59, 311 R, 392, 129, 191, 144–152, 250–284; 222/168.5

[56] References Cited

U.S. PATENT DOCUMENTS

| | | | |
|---|---|---|---|
| 3,123,105 | 3/1964 | Breeback | 141/147 |
| 3,378,173 | 4/1968 | Minard | 141/147 |

*Primary Examiner*—Houston S. Bell, Jr.

*Attorney, Agent, or Firm*—Andrus, Sceales, Starke & Sawall

[57] ABSTRACT

A valve assembly for a container filling machine. The filling machine includes a rotating turret or carrier having a series of platforms that support individual containers, such as cans, to be filled. Mounted above each platform is a valve assembly which controls the fluid flow to the can. Each valve assembly includes a valve body and a rotatable disc, and the body and the disc have mating surfaces, each containing ports that can be moved into registry as the disc is rotated with respect to the body to effect fluid flow. To rotate the disc during the cycle of operation, a single arm is attached to the disc and carries a follower which is adapted to engage a series of fixed cam tracks as the carrier rotates to move the arm and rotate the disc to obtain the desired registry of the ports.

4 Claims, 4 Drawing Figures

VALVE CONTROL CONSTRUCTION FOR A FILLING MACHINE

This is a continuation of application Ser. No. 937,149, filed Aug. 28, 1978, now abandoned.

BACKGROUND OF THE INVENTION

The conventional filling machine for filling beverage cans includes approximately one hundred valve assemblies which are mounted on a rotatable carrier or turret, and each valve assembly is positioned above a lift cylinder and platform which supports a can or other container to be filled with liquid. Each valve assembly is connected to a central filler tank by three tubes; a large diameter tube provides a passage for the beer or other liquid to move from the tank to the valve assembly, while two smaller diameter tubes serve to conduct carbon dioxide and air between the tank and valve assembly.

The valve assembly, as used in the conventional filling machine, includes a valve body, a rotatable disc which is mounted for rotation with respect to the valve body, and an adapter which is connected to the valve body and seals against the top of the can to be filled. Both the valve body and the disc have mating flat surfaces and ports in the disc and the valve body are adapted to be brought into registry as the disc is rotated to provide the desired liquid and gas flow between the filler tank and the can.

To rotate the disc with respect to the valve body, the conventional valve assembly includes a pair of arms which extend outwardly from the disc, and the arms are adapted to contact a series of fixed cams as the carrier rotates to thereby rotate the disc and bring the ports in the disc and valve body into proper registry.

The conventional filling machine operates at high speeds, generally filling about 1500 cans per minute. At this high speed, there is considerable impact when the arms, which are located at an angle of approximately 90° with respect to the direction of movement of the valve assembly, strike the cam surfaces, resulting in substantial wear on the arms and cam surfaces, and in some cases breakage of the arms, which produces a serious maintenance problem.

As an additional problem, at high operating speeds, the arms may tend to over-ride when leaving the cam surface, that is, continue to rotate beyond the proper point of index, with the result that the ports in the disc and the valve body are not in proper registry. By increasing the biasing force between the contiguous faces of the valve body and the disc, the tendency to override can be reduced. However, increasing the biasing force will necessitate an increased force to move the arms and rotate disc, and this results in additional wear on the arms and cam surfaces. On the other hand, if the biasing force is decreased, the tendency to over-ride or boucce off the cam surface is increased, resulting in possible misalignment between the ports in the disc and the valve body.

SUMMARY OF THE INVENTION

The invention is directed to an improved valve assembly for a can filling machine. The valve assembly includes a body and a rotatable disc having mating flat surfaces, each containing ports that can be moved into registry as the disc is rotated with respect to the valve body to obtain the desired fluid flow.

In accordance with the invention, a single arm is secured to the rotatable disc and the arm has an amplitude of movement in a vertical plane of about 65° between a first position, where the arm is inclined downwardly with respect to a horizontal plane passing through the pivotal connection, to a second position where the arm is located at an upwardly inclined angle with respect to the horizontal plane.

The outer end of the arm carries a pin or follower which is adapted to engage fixed cam surfaces as the valve assembly rotates with the carrier to thereby move the arm and rotatable disc relative to the valve body. Each cam surface terminates in a track defined by generally parallel walls or surfaces, so that as the valve assembly rotates with the carrier, the follower will move into the track and will be contained by the walls of the track to precisely position the disc and prevent any possibility of override or bouncing of the follower at high operating speeds.

The valve assembly of the invention thus provides better fill control at high speeds due to the fact that the ports in the rotating disc are precisely registered with respect to the ports in the valve body.

As the position of the cam follower is precisely controlled as the follower leaves the cam and overriding is prevented, a simplified spring mechanism of lesser force can be utilized to urge the mating surfaces of the disc and valve body into contact. The biasing or spring mechanism preferably takes the form of a pair of resilient O-rings which are mounted between the rotatable disc and the fixed valve body. Through adjustment of a thrust nut the compression of the O-rings can be varied to thereby control the biasing force between the mating faces on the valve body and the rotating disc.

As the arm at all times is at an angular trailing position with respect to the direction of travel of the valve assembly, a lesser force is required to pivot the arm than in conventional valve assemblies in which the arms are normally located at an angle close to 90° with respect to the path of travel of the valve assembly. The trailing attitude of the arms also minimizes wear on the arms due to impact with the cam surfaces.

As the valve assembly of the invention reduces the impact or force of the arms against the cam surface the operation of the filling machine is noticeably more quiet than that of conventional types of filling machines.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
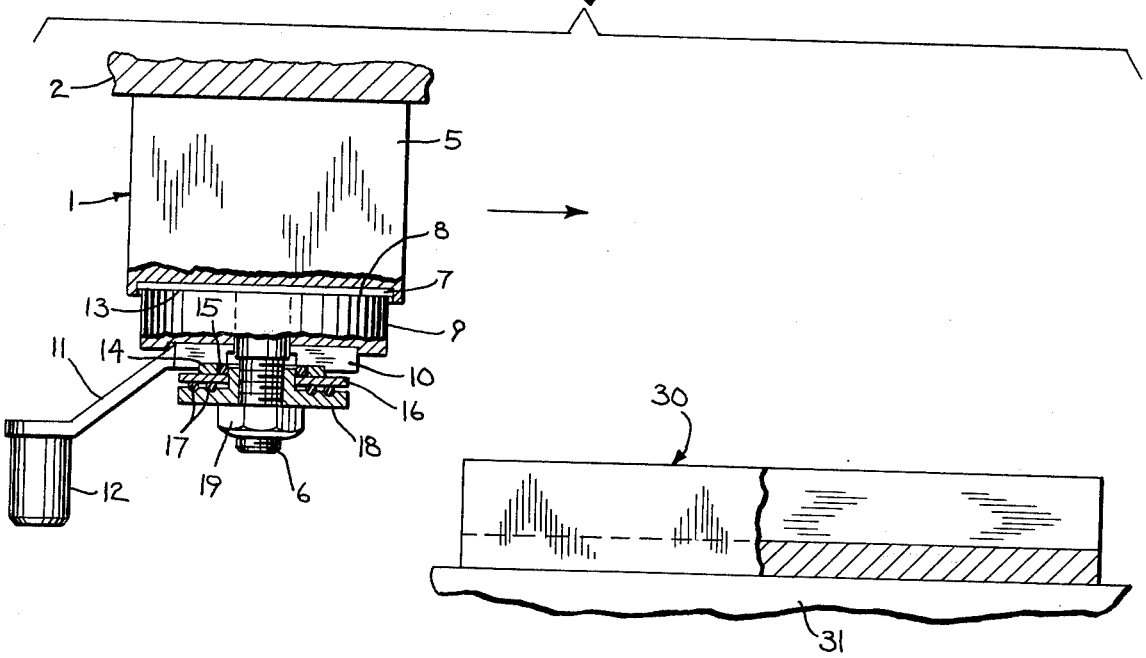
FIG. 1 is a top plan view of the valve assembly of the invention with parts broken away in section.
Figures 2, 3:
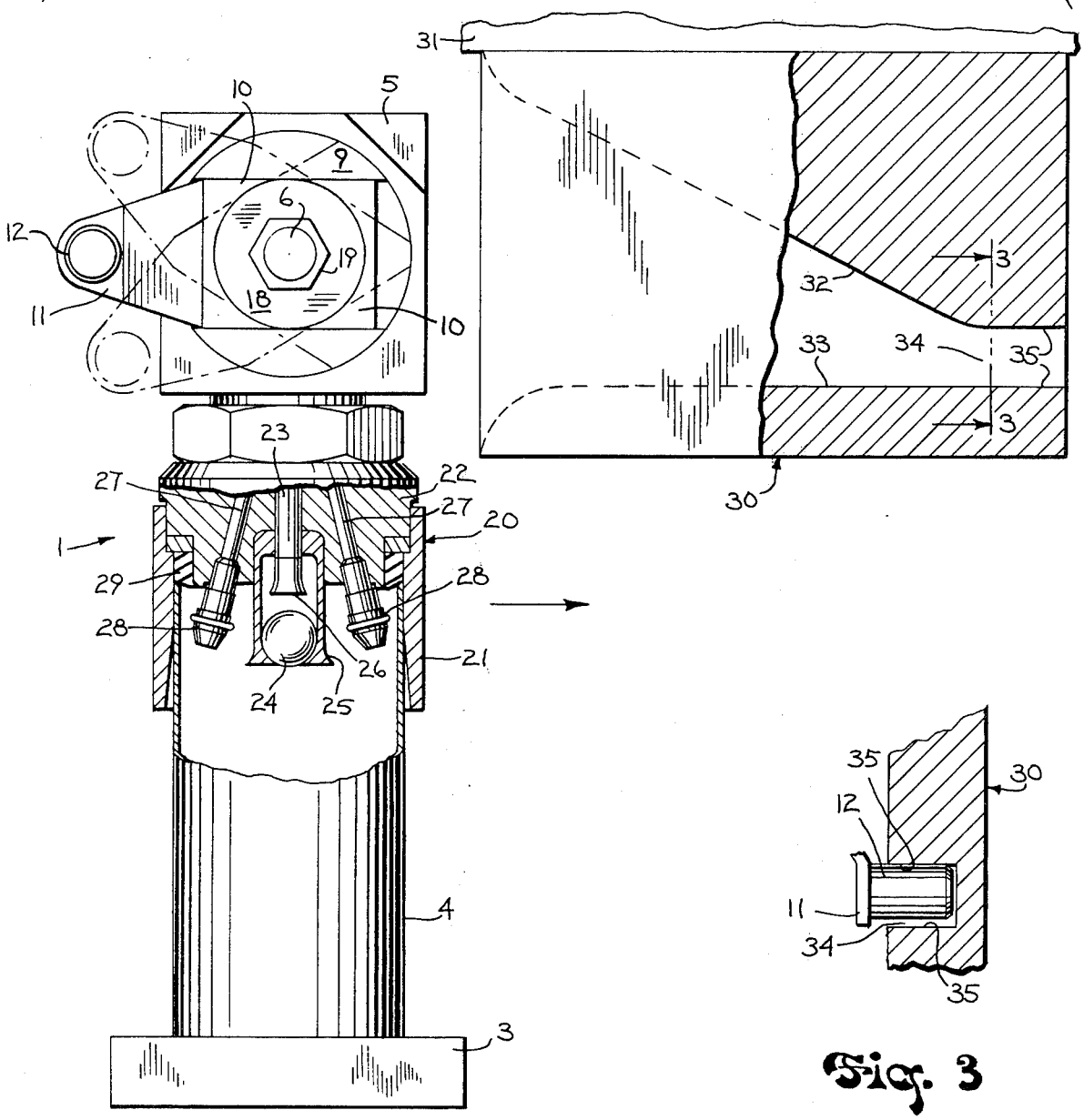
FIG. 2 is a side elevation of the valve assembly with parts broken away in section.
FIG. 3 is a section taken along line 3—3 of FIG. 1; and showing the engagement of the follower with the cam member.

FIGS. 1–3 illustrate the improved valve assembly of the invention which is associated with a conventional filling machine, such as that employed for filling beer or soft drink cans. The filling machine includes approximately one hundred valve assemblies 1 which are mounted for rotation on a rotatable carrier or turret 2. Positioned beneath each valve assembly is a lift cylinder platform 3 which supports the can to be filled with liquid.

The filling machine in itself is a standard type. In operation of the conventional filling machine, an empty can 4 is placed on the lift cylinder platform 3 by the in-feed spider conveyor, and the platform is elevated to seal the can against the valve assembly. As the carrier rotates, the pressure in the can is then equalized with the pressure in the filler tank and the can then passes to a detection station where the valve assembly is moved to a shut-off position if there is no can on the platform. Continued rotation of the carrier acts to supply liquid to the can while venting air from the can. After the can has been filled to the proper level, the supply of liquid is shut off, the lift cylinder platform descends carrying the filled can away from the valve assembly and the filled can is then conveyed from the filling machine. After the can is removed from the valve assembly, the lines are blown out to the atmosphere to evacuate any foam or liquid that may have entered the passages during the filling operation.

The valve assembly of the invention includes a valve body 5 which is mounted on the rotating carrier 2 and a horizontal shaft 6 extends outwardly from the body. A packing disc 7 is attached to the outer surface of the valve body. Disposed in engagement with the outer surface 8 of packing disc 7 is a disc 9 formed of a material, such as polytetrafluoroethylene, having a low coefficient of friction, and the disc 9 is journalled for rotation on shaft 6.

As best illustrated in FIG. 1, the base 10 of an arm 11 is mounted within a recess in the outer face of the disc 9 and the outer end of the arm 11 carries a pin or follower 12 which is adapted, at intervals during rotation of the carrier valve assembly, to ride against a cam surface as will be hereinafter described. As shown in FIG. 2, the arm 11 is the only arm connected to the disc 9.

A biasing mechanism is utilized to urge the inner surface 13 of the disc 9 into engagement with the mating surface 8 of the valve packing 7. The biasing mechanism includes a thrust washer 14 and O-ring seal 15 which are mounted concentrically within a groove in the outer face of base 10 of arm 11. A washer 16 bears against the outer surfaces of washer 14 and seal 15, and a pair of concentric O-rings 17 are mounted within grooves in the head of a thrust nut 18 and bear against the outer surface of washer 16. As shown in FIG. 1, thrust nut 18 is threaded on the outer end of the shaft 6 and is retained thereon by a nut 19.

Threading down thrust nut 18 on shaft 6 will compress O-rings 17, thereby increasing the biasing force between the sealed, mating faces 13 and 8 of the disc 9 and the packing 7.

The valve body 5, itself, is of conventional construction and contains a number of internal passages, now shown, for beer, carbon dioxide and air which extend to the back surface of the body and are connected by suitable tubes to the filler tank. The passages in the valve body communicate with ports, located in the outer surface 8 and the ports are adapted to register with ports formed in the mating face 13 of the rotatable disc as the disc is rotated. The ports in the disc face communicate through passages in the disc to other ports in the face of the valve body which in turn are connected by internal passages to the can 4 being filled.

The passages and ports in the valve body 5 and valve disc 9 which provide the desired flow of beer, carbon dioxide and air during the filling operation, are conventional and in themselves form no part of the present invention.

The valve body 5 carries a conventional adapter 20 and the can 4 to be filled seals against the adapter. The adapter 20 is a conventional type and in itself forms no part of the present invention.

As best shown in FIG. 2, the adapter includes a centering bell 21 which extends downwardly form the main body 22 of the adapter. A central air vent tube 23 extends vertically through the body 22 and is adapted to be closed off by a ball check valve 24, which is mounted within a cage 25. The lower end of the tube 23 defines a valve seat 26 and when the liquid in the can 4 rises to a pre-determined level, the check valve 24 will float upwardly into engagement with the seat 26 to prevent further air from being discharged from the can and thus prevent further liquid from being introduced into the can.

The adapter 20 is formed with a pair of passages 27 through which beer or other liquid is introduced into the can 4, and the passages are connected to diverging jets 28.

Mounted within an annular recess of the body 22 of the adapter is a seal 29 and the upper edge of the can 4 bears against the seal.

In accordance with the invention, the disc 9 is adapted to be rotated with respect to the valve body 5 by engagement of the follower 12 with a series of fixed cam members 30 which are mounted on the supporting structure or frame 31 of the filling machine. Each cam member 30 is formed with a recess in one surface which defines a pair of cam surfaces 32 and 33, which lead into a track 34 having generally parallel walls 35. As the carrier rotates in the direction of the arrow in FIG. 2, the follower 12, which is shown to be in a central or neutral position in FIG. 2, engages the upper cam surface 32, thereby camming the arm 11 downwardly to a lower position. Continued rotation of the carrier 2 and valve assembly 1 will cause the follower 12 to move into the track 34 and as the follower is contained by the track walls 35, the follower is precisely positioned so as to accurately align the ports in the disc 9 with the ports in the valve body 5. With this construction, even at high speed operation, the position of the follower 12, as it leaves the cam member 30, will be precisely positioned, so that there will be positive alignment of the porting between the disc and valve body and there will be no possibility of override or bounce of the follower from the cam surface. This results in better fill control at high speed operation.

Figure 4:
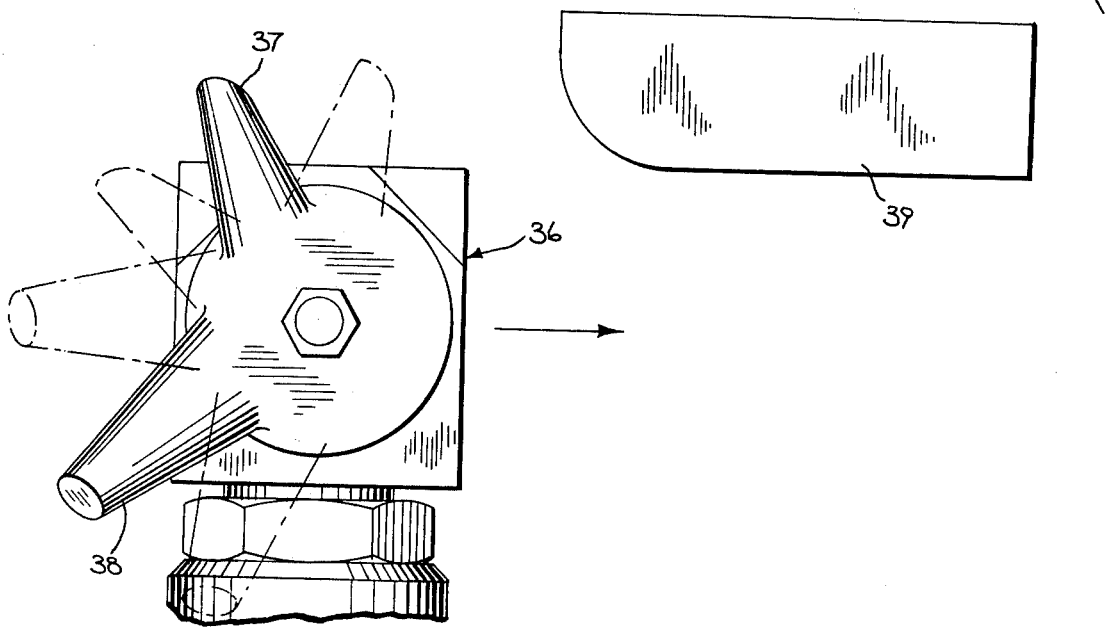
FIG. 4 is a view similar to FIG. 2 showing the prior art type of valve assembly using a pair of arms.

FIG. 4 illustrates a valve assembly 36 of the prior art which includes a pair of arms 37 and 38 that extend outwardly from the valve body. The full line position in FIG. 4 shows an intermediate position of the arms 37 and 38, while the phantom lines illustrate the extreme positions of each arm. As the prior art valve body of FIG. 4 travels with the carrier, one of the two arms will engage a fixed cam member to thereby rotate the arm and the valve disc. As shown in FIG. 4, the arm 37 will engage the cam member 39. At certain times during the operating cycle, the arms 37 and 38 may be located at an angle approximating 90° with respect to the direction of travel of the valve assembly when the arms engage the cams. At this angle, there will be considerable impact, resulting in wear on the arm and the cam surface.

In contrast to this, the single arm 11 of the valve assembly of the invention is at all times at a trailing position with respect to the direction of travel of the valve assembly (the extreme positions of movement are shown by the phantom lines in FIG. 2), so that the arm will be at an acute trailing angle when it engages a cam surface, thereby reducing the impact and substantially decreasing the wear on the arm and cam surface.

The valve assembly of the prior art, as shown in FIG. 4 includes a single cam surface and at high speed operation the arms can override or bounce off of the cam surface, resulting in misalignment of the porting in the disc 9 and valve body 5. This problem is eliminated with the valve assembly of the invention in which the cam follower 12 passes through the track 34 as it leaves the cam member 30, insuring that there will be no override or bounce and that the arm 11 and disc 9 will be in the proper position relative to the valve body 5.

Various modes of carrying out the invention are contemplated as being within the scope of the following claims particularly pointing out and distinctly claiming the subject matter which is regarded as the invention.

We claim:

1. In a filling machine, a supporting structure, a carrier mounted for rotation with respect to the supporting structure, a valve assembly mounted on the carrier and including a valve body having a first generally flat face, a disc mounted for rotation with respect to the body about an axis and having a generally flat second face disposed in mating engagement with said first face, said first and second faces having ports therein adapted to be brought into registry as the disc is rotated relative to the valve body, a single cam operated arm connected to the disc and extending outwardly from the disc and having an outer end portion, said arm being the only cam operated arm connected to said disc and said arm being disposed rearwardly at a trailing angle with respect to the direction of travel of said valve assembly, and cam means mounted on the supporting structure and including a cam surface disposed to be engaged by said end portion as the valve assembly travels with the carrier, said cam means also including a track disposed downstream in the direction of travel of the valve assembly from said cam surface, said track having opposed spaced wall to receive and confine said end portion, said track serving to precisely position the arm and disc as the end portion leaves said cam surface.

2. The machine of claim 1, wherein said arm is mounted for pivoting movement in a vertical plane between a first and a second position, said positions being located on either side of a horizontal plane passing through said axis.

3. The machine of claim 3, wherein said first and second positions are approximately 65° apart.

4. The machine of claim 1, and including a shaft projecting outwardly from the valve body and extending through an opening in said disc, adjusting means secured to the outer end of the shaft, and at least one resilient ring operably interposed between the disc and the adjusting means, said resilient ring serving to bias said disc into engagement with said valve body, adjustment of said adjusting means acting to vary the biasing force between the disc and the valve body.

* * * * *

UNITED STATES PATENT AND TRADEMARK OFFICE

CERTIFICATE OF CORRECTION

PATENT NO. : 4,253,505

DATED : March 3, 1981

INVENTOR(S) : HENRY SAUER and STEVEN A. LOCKHART

It is certified that error appears in the above-identified patent and that said Letters Patent are hereby corrected as shown below:

Column 3, line 60, Cancel "now" and substitute therefor ---not---

Column 6, line 22, CLAIM 3, Cancel "3" and substitute therefor ---2---

Signed and Sealed this

*Twenty-third* Day of *June 1981*

[SEAL]

*Attest:*

RENE D. TEGTMEYER

*Attesting Officer*

*Acting Commissioner of Patents and Trademarks*